US005289084A

United States Patent [19]

Nuckolls et al.

[11] Patent Number: 5,289,084

[45] Date of Patent: Feb. 22, 1994

[54] LAMP ARRANGEMENT EMPLOYING A RESONANT CIRCUIT FORMED FROM AN AUTOTRANSFORMER AND A CAPACITOR WHERE THE CAPACITOR IS SWITCHED OUT OF THE RESONANT CIRCUIT AND INTO A POWER FACTOR CORRECTING CIRCUIT WHEN THE IGNITION OF THE LAMP IS SENSED

[75] Inventors: Joe A. Nuckolls, Blacksburg, Va.; Yan Wang, Northbrook, Ill.

[73] Assignee: Hubbell Incorporated, Orange, Conn.

[21] Appl. No.: 904,969

[22] Filed: Jun. 26, 1992

[51] Int. Cl.[5] ..... H05B 37/02

[52] U.S. Cl. ..... 315/247; 315/289; 315/290; 315/240; 315/244; 315/DIG. 5

[58] Field of Search ..... 315/289, 290, 240, 227 R, 315/244, DIG. 5, 247

[56] References Cited

U.S. PATENT DOCUMENTS

| | | | |
|---|---|---|---|
| 3,732,460 | 5/1973 | Wattenbach | 315/247 |
| 4,480,214 | 10/1984 | Sodini | 315/290 |
| 4,866,347 | 9/1989 | Nuckolls et al. | 315/158 |
| 5,047,694 | 9/1991 | Nuckolls et al. | 315/290 |

*Primary Examiner*—Robert J. Pascal
*Assistant Examiner*—Michael B. Shingleton
*Attorney, Agent, or Firm*—Oblon, Spivak, McClelland, Maier & Neustadt

[57] ABSTRACT

An improved fluorescent ballast circuit for 277 volt commercial application is disclosed utilizing a resonant circuit mechanism to generate high open circuit voltage (OCV) during lamp starting. The result is an energy efficient effective lighting system for commercial buildings.

7 Claims, 5 Drawing Sheets

LAMP ARRANGEMENT EMPLOYING A RESONANT CIRCUIT FORMED FROM AN AUTOTRANSFORMER AND A CAPACITOR WHERE THE CAPACITOR IS SWITCHED OUT OF THE RESONANT CIRCUIT AND INTO A POWER FACTOR CORRECTING CIRCUIT WHEN THE IGNITION OF THE LAMP IS SENSED

BACKGROUND OF THE INVENTION

1. Field of the Invention

The present invention relates to improved ballast circuitry for high wattage, high LPW (lumens per watt) fluorescent lamps.

2. Discussion of Background

New higher efficiency compact lighting systems are becoming available in home use, however the design of comparable higher efficiency compact systems for fluorescent office and commercial lighting fixtures has been hindered by the lack of practical circuits for starting and operating high wattage commercial fluorescent light switch operated from a 220–347 volt line. These new higher wattage lamps can generate a lumen per watt of between 80 and 100 LPW but thus far the development of an efficient and effective lighting system for commercial buildings has been hindered by a lack of sufficient practical and efficient starting and operating circuitry.

The use of a 277 volt open circuit (OCV) used in the U.S. or a 347 volt (OCV) as in Canada does not provide an efficient positive lamp starting unless large energies are supplied by starting circuitry. These large energies defeat attempts to utilize such lamps in an efficient system.

The present invention provides the necessary voltage in an efficient manner for positive lamp starting for high wattage, high LPW fluorescent lamps in an industrial configuration.

SUMMARY OF THE INVENTION

Accordingly, it is an object of the present invention to provide a compact size, low loss, fluorescent ballast system for use with a 277 volt line.

It is another object of the invention to provide an efficient fluorescent system for commercial buildings and which produces high wattage high LPW input and output.

These and other objects are accomplished by a ballast system using resonant circuit mechanisms in order to provide the required open circuit voltage (OCV). For a start up of a 96 watt fluorescent lamp, a combination of a capacitor and an inductance resonant at 120 Hz was used to generate an open circuit voltage of approximately 436 volts during lamp ignition. A fluorescent starter provides a lamp filament preheat while low energy high voltage ionization pulses are provided as a positive temperature coefficient resistance is heated.

DETAILED DESCRIPTION OF THE PREFERRED EMBODIMENTS

Figure 1:
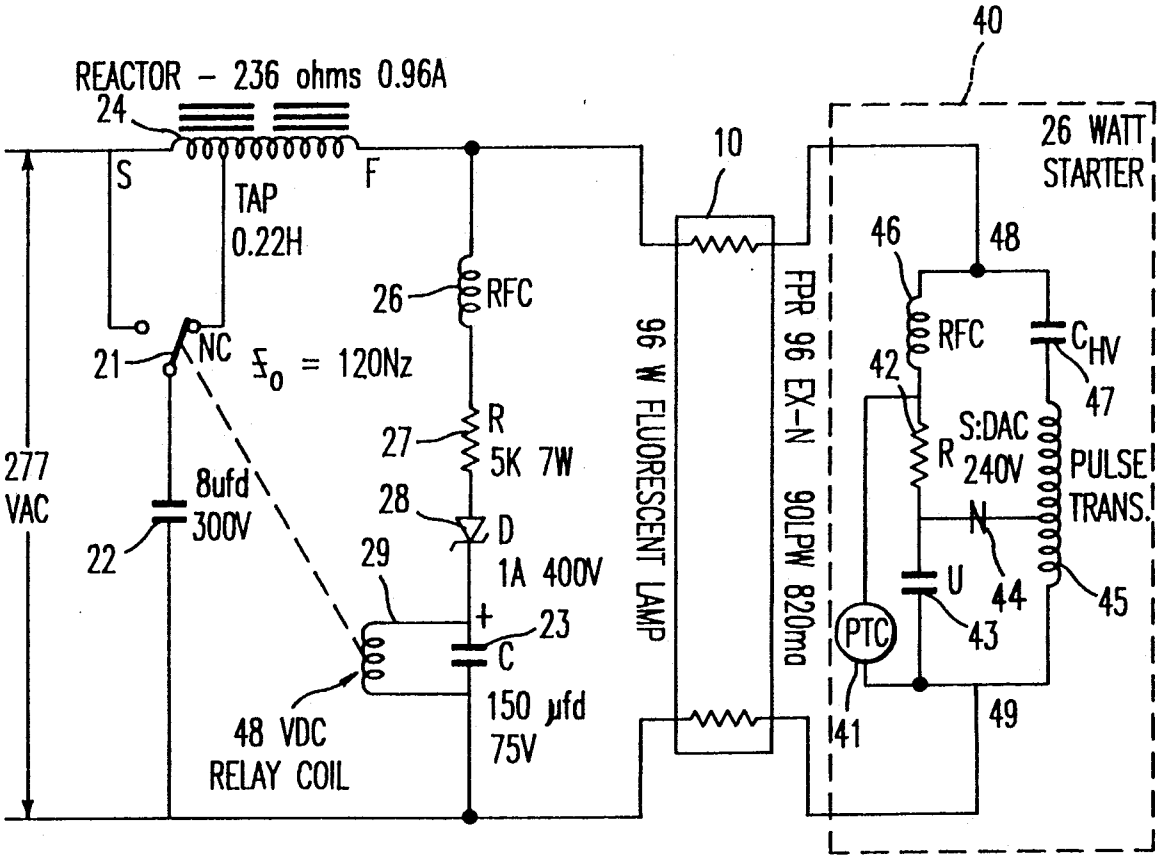
FIG. 1 is a fluorescent ballast circuit for a 96 watt lamp according to one embodiment.

The use of resonant circuit mechanisms to provide energy efficient open circuit voltages (OCV) is illustrated in the circuitry of FIG. 1 which is provided in conjunction with a 96 watt fluorescent lamp 10 which is to be started and operated from a 277 volt source typical for commercial buildings. The generation of the open circuit voltage of approximately 436 volts RMS is accomplished by using the 8 microfarad (mfd) capacitor with a tapped reactor 24 which has a total reactance of 236 ohms. The tapped portion encompasses 0.22 henry with the total inductance of the reactor 24 being 0.66 henry. A 26 watt fluorescent starter 40 provides the lamp filament preheat as the positive temperature coefficient (PTC) resistor 41 heats up, at which time low energy high voltage (3–4 KV) ionization pulses are generated and applied across the hot filament lamp. When the lamp ignitor and the voltage drops due to full lamp current flow, the 26 watt starter 40 is clamped off as is the 8 microfarad capacitor transfer circuit and, as the 48 volt relay 29 drops out, the capacitor 22 is transferred to the source (S) side of the reactor 24 in order that it may act as a power factor corrector capacitor during normal lamp operation.

The 26 watt starter 40 in the FIG. 1 uses a combination of the resistor 42 and capacitor 43 in parallel with the PTC 41. Connected between the junction of resistor 42 and capacitor 43 is one terminal of the SIDAC whose other terminal is tapped in the pulse transformer 45. The starter circuit also involves a radio frequency choke 46 connected at one end to PCT 41 and resistor 42 and at the other end to an output terminal 48. Connected in parallel with the coil 46 is the capacitor 47 having one terminal connected to the pulse transformer 45 and another terminal connected to the output terminal 48. The starter 40 is described and claimed in U.S. Pat. No. 4,866,347.

The ballast circuit for relay operation of the relay coil 29 has a circuit with a coil 26, a resistor 27 and a diode 28 connected in series with each other and with the parallel combination of capacitor 23 and relay 29. The relay 29 operates the switch 21 in order to connect the capacitor 22 to the source side (S) during normal lamp operation. The DC time constant transfer circuit consisting of the capacitor 23, the resistor 27 and the coil 26 is used to sense the lamp's "off" or "burning" status and to transfer the capacitor without chatter or instability as the lamp changes modes or when line instantaneous phenomena occurs.

Figure 2:
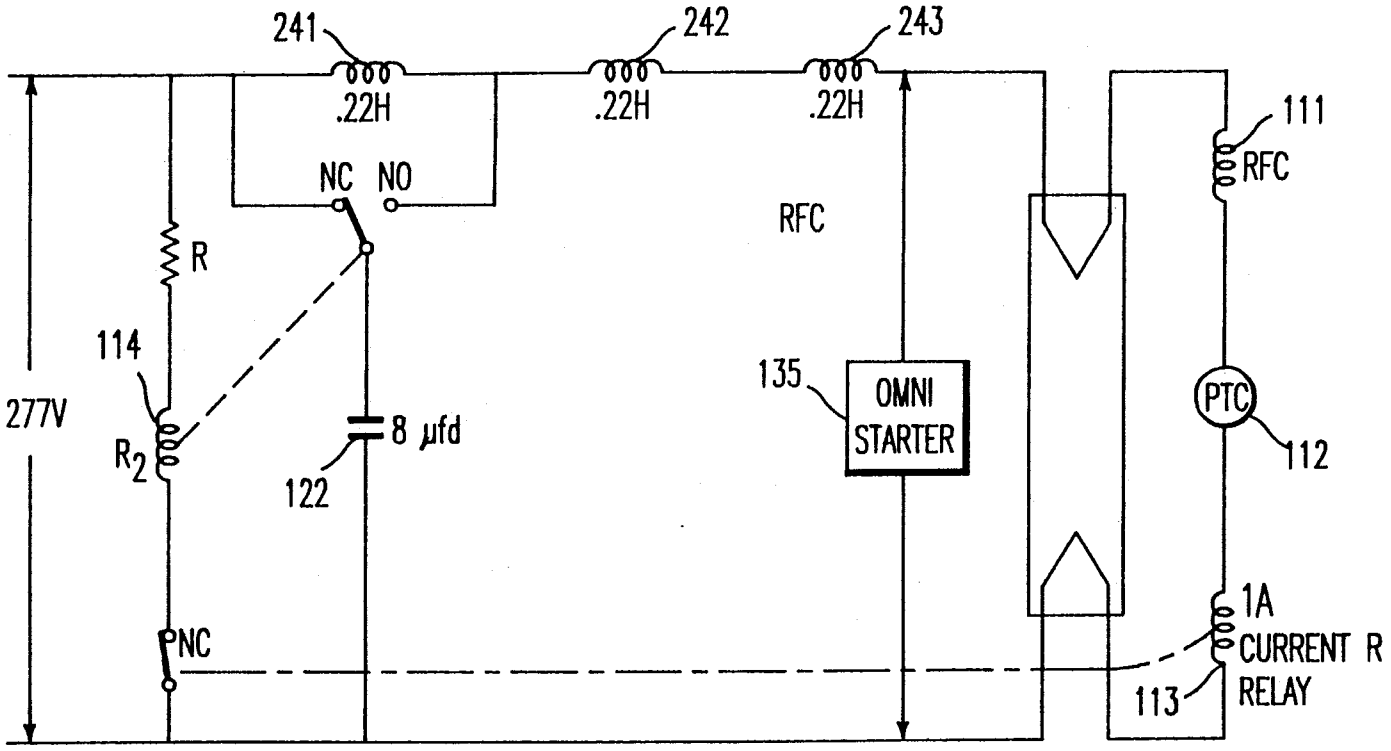
FIGS. 2–3 show alternate fluorescent ballast circuits for operating 96 watt fluorescent lamps.
Figure 3:
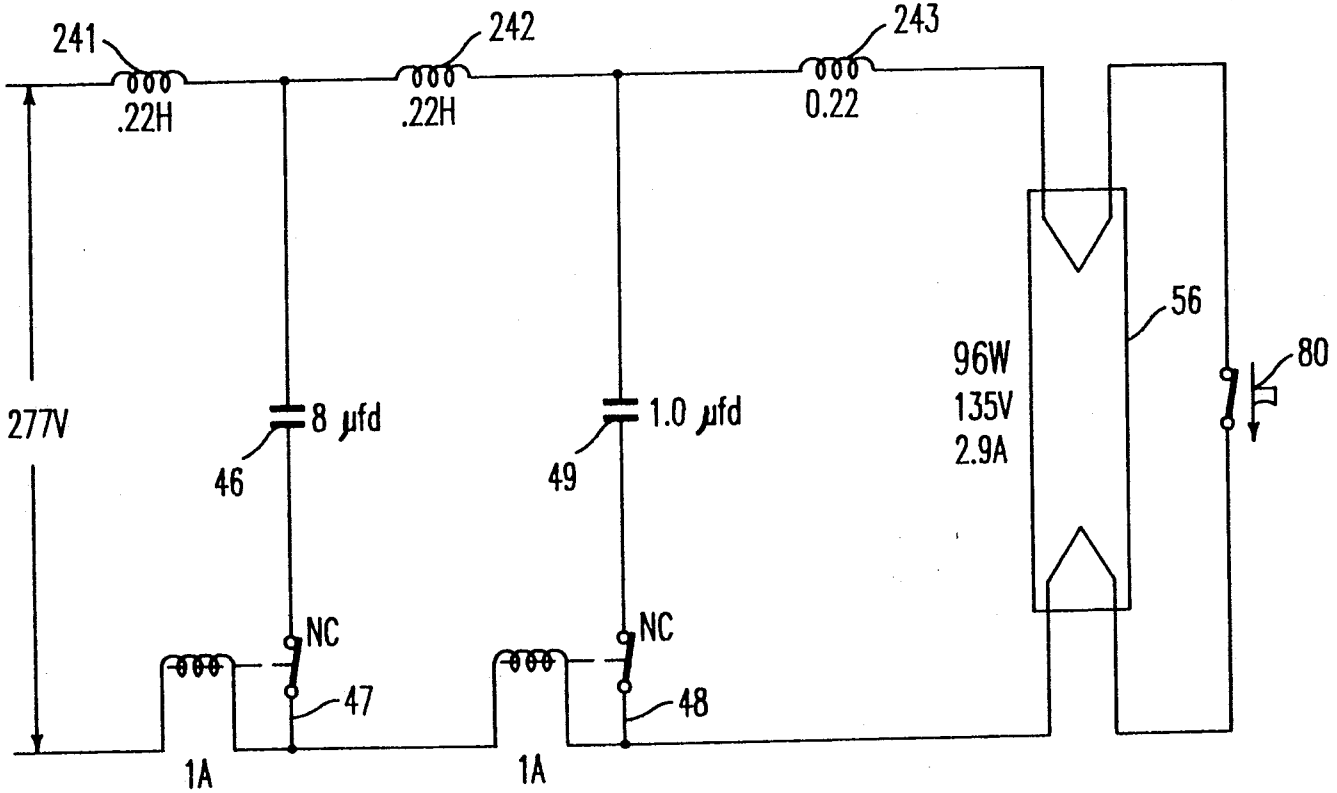

In an alternate form of the invention, the FIG. 2 shows a circuit in which the preheat resistance 112 is connected in series with a high voltage standoff RFC (radio frequency choke) 111 and with a current relay coil 113 which preheats the lamp filaments and transfers the 8 microfarad capacitor 122 through relay section 114. A resistor 115 is in series with relay section 114. In this embodiment ignition of the lamp occurs through the use of a OMNI starter 135. An OMNI starter is a 2-terminal circuit sold by Hubbell Corporation and available as Part No. 600-7000-3707. It is to be noted that, with the method of the present invention, multiple L-C networks can be used as shown in the FIG. 3. With some combinations of the lamps and sources this type of cascade arrangement of resonant circuit L-C networks may be required to operate the lamp. As a further modification, the reactor 24 from FIG. 1 can be divided into three separate reactors 241, 242 and 243 respectively as shown in the FIGS. 2 and 3. Each of these reactors have a value of 0.22 henry whereas the reactor 24 of FIG. 1 had a total of 0.66 henry with 0.22 henry being tapped by the operation of the relay 29 and the switch 21. The FIG. 3 embodiment uses an 8 microfarad capacitor 46 in conjunction with the switch coil pickup 47 in combination with a one microfarad capacitor 49 and a switch-coil pickup 48. This structure is used to operate the 96 W, 135 volt 0.9 ampere lamp 56 operated by switch 80.

Figure 4:
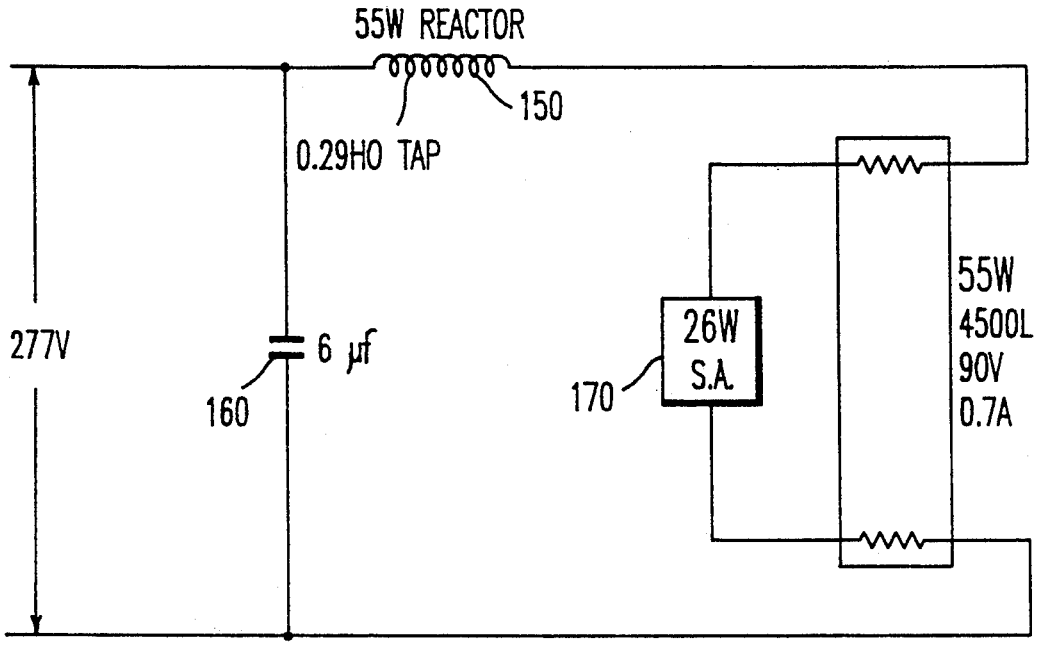
FIG. 4 is a preferred embodiment of a fluorescent ballast circuit for a 55 watt lamp.
Figure 5:
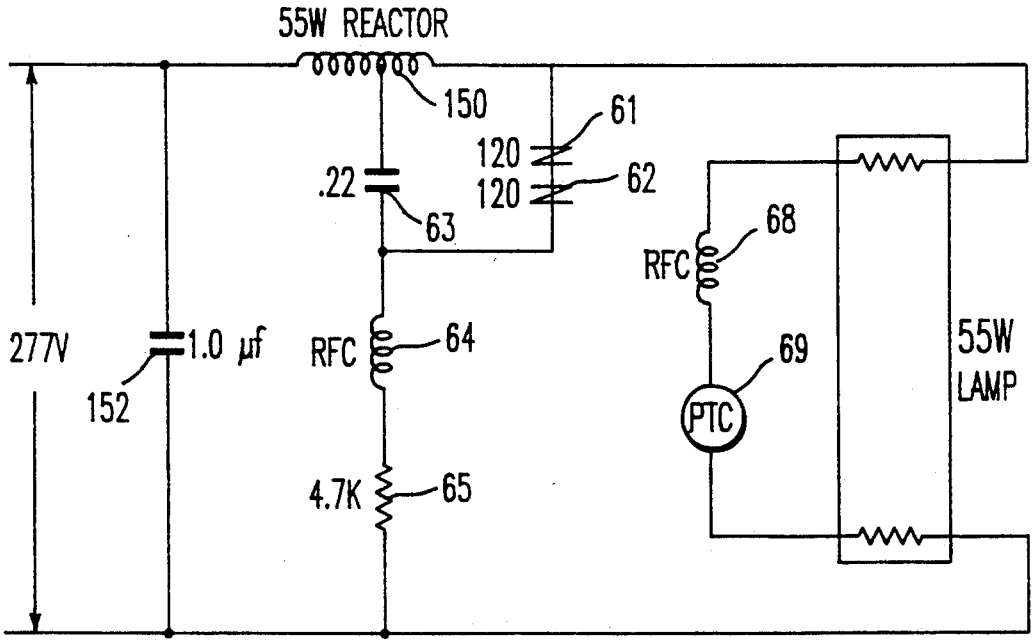
FIGS. 5–6 are alternate embodiments for ballast circuits for 55 watt lamps.

The FIG. 4 illustrates a resonance circuit embodiment for a fluorescent ballast to be used with a 55 watt, 4500 L lamp. This configuration utilizes a 6 microfarad capacitor 160 in conjunction with a 55 watt reactor 150 and the system is started by the 26 watt preheat and starter circuit 170 as discussed previously in conjunction with FIG. 1. As an alternative the FIG. 5 shows the use of a 1 microfarad capacitor 152 and a tapping of the 55 watt reactor 150 by a circuit formed by the 0.22 mfd capacitor 63, the RFC 64 and the 4.7K ohm resistor 65. The RFC 68 and the positive temperature coefficient resistor 69 is connected between the lamp filaments. Two 120 volt SIDACs 61, 62 or a single 240 V SIDAC is connected in parallel relationship with the 0.22 microfarad discharge capacitor 63.

Figure 6:
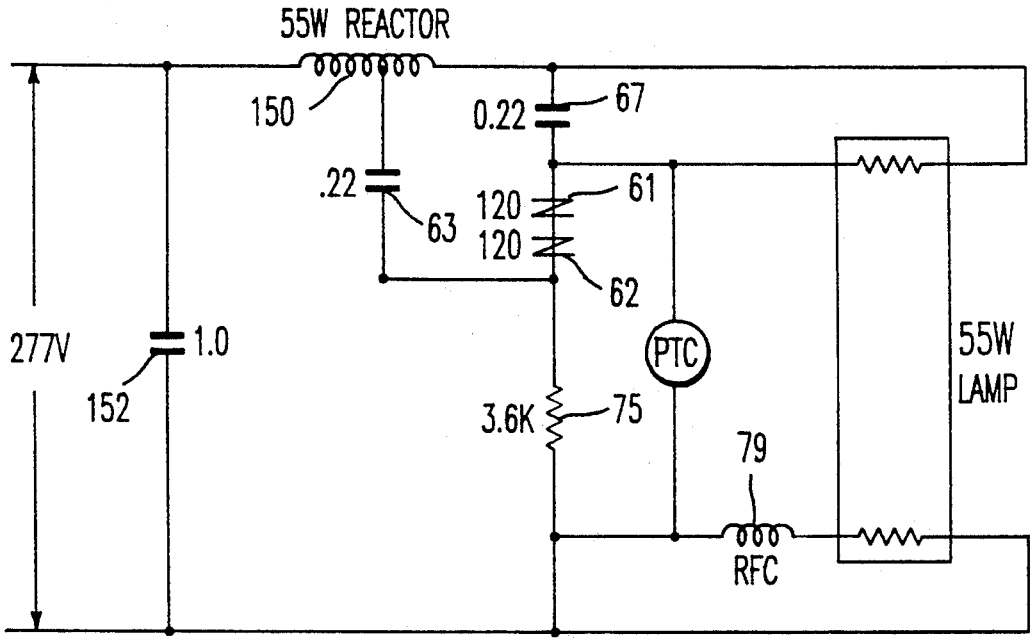

And yet another alternate embodiment, FIG. 6 shows a single rf choke 79 is used in conjunction with a 3.6K ohm resistor 75 with the positive temperature coefficient being connected between the capacitor 67 and the junction between the resistor 75 and the coil 79 which eliminates the need for two RF chokes.

Although described with respect to a 277 Open Circuit Voltage commercially used in the United States, other comparable commercially used systems such as the 377 volt designation used in Canada will be able to be utilized with the above described embodiments as the circuitry is able to cover a wide line voltage range.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An improved energy efficient ballast circuit for a commercial fluorescent lighting system using a standard commercial high voltage feed of between 220 and 347 volts for operating a high wattage, high lumen per watt fluorescent lamp, said circuit comprising:

starter means for preheating said lamp and for providing low energy high voltage ionization pulses, said starter means including a positive temperature coefficient resistor;

resonant circuit means including an inductance means and a capacitance means for generating an open circuit voltage significantly higher than said high voltage feed wherein said open circuit voltage is sufficient to start-up and stabilize said lamp;

relay means, responsive to a full current draw by said lamp, to clamp off said starter means and to transfer said capacitance means from said resonant circuit whereby said transferred capacitor means acts as a power factor corrector capacitance during normal lamp operation.

2. The ballast circuit according to claim 1, wherein said lamp is at least a 96 watt fluorescent lamp which provides between 80 and 84 lumens per watt.

3. The ballast circuit according to claim 1, wherein said capacitance means includes an 8 microfarad capacitor and wherein said reactor means is 230 ohm, 0.9 amp, 0.22 henry inductance and wherein said resonant circuit means provides an open circuit voltage of approximately 436 volts RMS during lamp ignition and starting.

4. The ballast circuit according to claim 1, wherein said high voltage ionization pulses are at least 3 kilovolts.

5. The ballast circuit according to claim 1, wherein said relay means includes a DC time constant transfer circuit to sense the "on" or "off" status of said lamp.

6. The ballast circuit according to claim 1, wherein said relay means includes a relay coil responding to the status of said lamp to provide a signal to control a switch for said transfer of said capacitance means from said resonant circuit in order to provide said power factor correction during normal operation of said lamp.

7. An improved energy efficient ballast circuit for a commercial fluorescent lighting system using a standard high voltage commercial feed between 220 and 347 volts for operating a high wattage, high lumen per watt fluorescent lamp, said circuit comprising:

a filament preheat circuit means including a positive temperature coefficient preheat resistance connected in series with a high voltage standoff RFC (radio frequency choke) for preheating filaments of said lamp to emmissive temperatures;

current relay means connected in series with said preheat means;

resonant circuit means including an inductance and a capacitance means for generating an open circuit voltage which is substantially at least 1.5 times larger than said high voltage feed; and means for switching, in response to said current relay, said capacitance means from said resonant circuit means to form a power factor correction capacitor circuit during normal lamp operation.

* * * * *